US006400104B1

(12) United States Patent
Ham

(10) Patent No.: US 6,400,104 B1
(45) Date of Patent: Jun. 4, 2002

(54) FLUORESCENT LAMP ASSEMBLY WITH NIGHTLIGHT

(76) Inventor: Byung Il Ham, 16550 E. Blackburn Dr., La Mirada, CA (US) 90638

( * ) Notice: Subject to any disclaimer, the term of this patent is extended or adjusted under 35 U.S.C. 154(b) by 0 days.

(21) Appl. No.: 09/659,632

(22) Filed: Sep. 12, 2000

(51) Int. Cl.[7] ..... H05B 37/00

(52) U.S. Cl. ..... 315/312; 315/200 A; 315/56; 315/58; 315/246; 362/216; 362/221; 362/222; 362/396

(58) Field of Search ..... 315/291, 56, 58, 315/246, 178, 312, 200 A, 320; 362/216, 221, 222, 396, 227

(56) References Cited

U.S. PATENT DOCUMENTS 4,218,637 A * 8/1980 Zelina, Jr. ..... 315/313
4,350,929 A * 9/1982 Katoogi ..... 315/49
4,358,710 A * 11/1982 Magai ..... 315/101
4,386,296 A * 5/1983 Beck ..... 315/53
4,454,451 A * 6/1984 Metoff ..... 315/58
4,494,041 A * 1/1985 Roche et al. ..... 315/49
5,039,915 A * 8/1991 Lu ..... 315/175
5,301,456 A * 4/1994 Jobin et al. ..... 43/113
5,345,149 A 9/1994 Ham ..... 315/244
6,169,373 B1 * 1/2001 Riesinger ..... 315/200 A
6,204,602 B1 * 3/2001 Yang et al. ..... 315/58
6,227,677 B1 * 5/2001 Willis ..... 362/196

* cited by examiner

*Primary Examiner*—Don Wong
*Assistant Examiner*—Tuyet Vo
(74) *Attorney, Agent, or Firm*—Blakely Sokoloff Taylor & Zafman

(57) ABSTRACT

A compact lamp unit is described which functions both as a fluorescent lamp and as a nightlight. The lamp unit includes a housing, a fluorescent tube, a low power light source, a conductive base and first and second circuits. The housing is used to contain a number of components and to support the fluorescent tube and low power light source. The conductive base is attached to a neck portion of the housing and has contact terminals adapted for a three-way lamp socket. The first circuit is electrically connected between the fluorescent tube and two of the contact terminals to drive the fluorescent tube. The second circuit is electrically connected between the low power light source and two of the contact terminals to drive the low power light source.

26 Claims, 8 Drawing Sheets

FLUORESCENT LAMP ASSEMBLY WITH NIGHTLIGHT

BACKGROUND OF THE INVENTION

1. Field of the Invention

The present invention generally relates to a fluorescent lamp, and in particular, to compact fluorescent lamps providing multiple levels of illumination.

2. Description of the Related Art

For purposes of assisting family members and guests navigate their way through corridors and rooms in the darkness, a wide variety of nightlights have been proposed. In many implementations, nightlights are adapted for use with an electrical outlet in the wall. While these conventional nightlights are popular with some users, others choose not to use them for various reasons including lack of electrical outlets available for these conventional plug-in type nightlights.

There have been efforts directed toward providing fluorescent lamps with multiple levels of illumination. Presently, there are a number of three-way fluorescent lamps available for use with a three-way lamp socket and they are becoming increasingly popular since the level of illumination can be selectively adjusted and they consume substantially less electrical power than an equivalent three-way incandescent lamp. Some users use a three-way fluorescent lamp to provide nighttime illumination by intentionally leaving the lamp turned on at its lowest setting during sleep period. One disadvantage associated with using a conventional three-way fluorescent lamp as a nightlight is that even at its lowest setting, the illumination provided by the lamp is not suitable for use as a nightlight and can be blinding to those whose eyes have been adjusted to the darkness. Another disadvantage associated with the conventional three-way fluorescent lamps is that variable switching elements incorporated into these lamps to control the level of illumination are expensive to manufacture.

Therefore, what is needed is a single lamp unit that is relatively inexpensive to manufacture and is capable of functioning both as a fluorescent lamp and as a nightlight.

SUMMARY OF THE INVENTION

According to one aspect of the present invention, a compact lamp unit is provided which functions both as a fluorescent lamp and as a nightlight. The lamp unit includes a housing, a fluorescent tube, a low power light source, a conductive base and first and second circuits. The housing is used to contain a number of components and to support the fluorescent tube and low power light source. The conductive base is attached to a neck portion of the housing and has contact terminals adapted for a three-way lamp socket. The first circuit is electrically connected between the fluorescent tube and two of the contact terminals to drive the fluorescent tube. The second circuit is electrically connected between the low power light source and two of the contact terminals to drive the low power light source.

DETAILED DESCRIPTION OF THE INVENTION

Implementations of the present invention are described herein for purposes of illustration, namely a single compact lamp unit that functions both as a fluorescent lamp and as a nightlight. For purposes of explanation, specific embodiments are set forth to provide a through understanding of the present invention. However, it will be understood by one skilled in the art that the invention may be practiced without these details.

Figure 1:
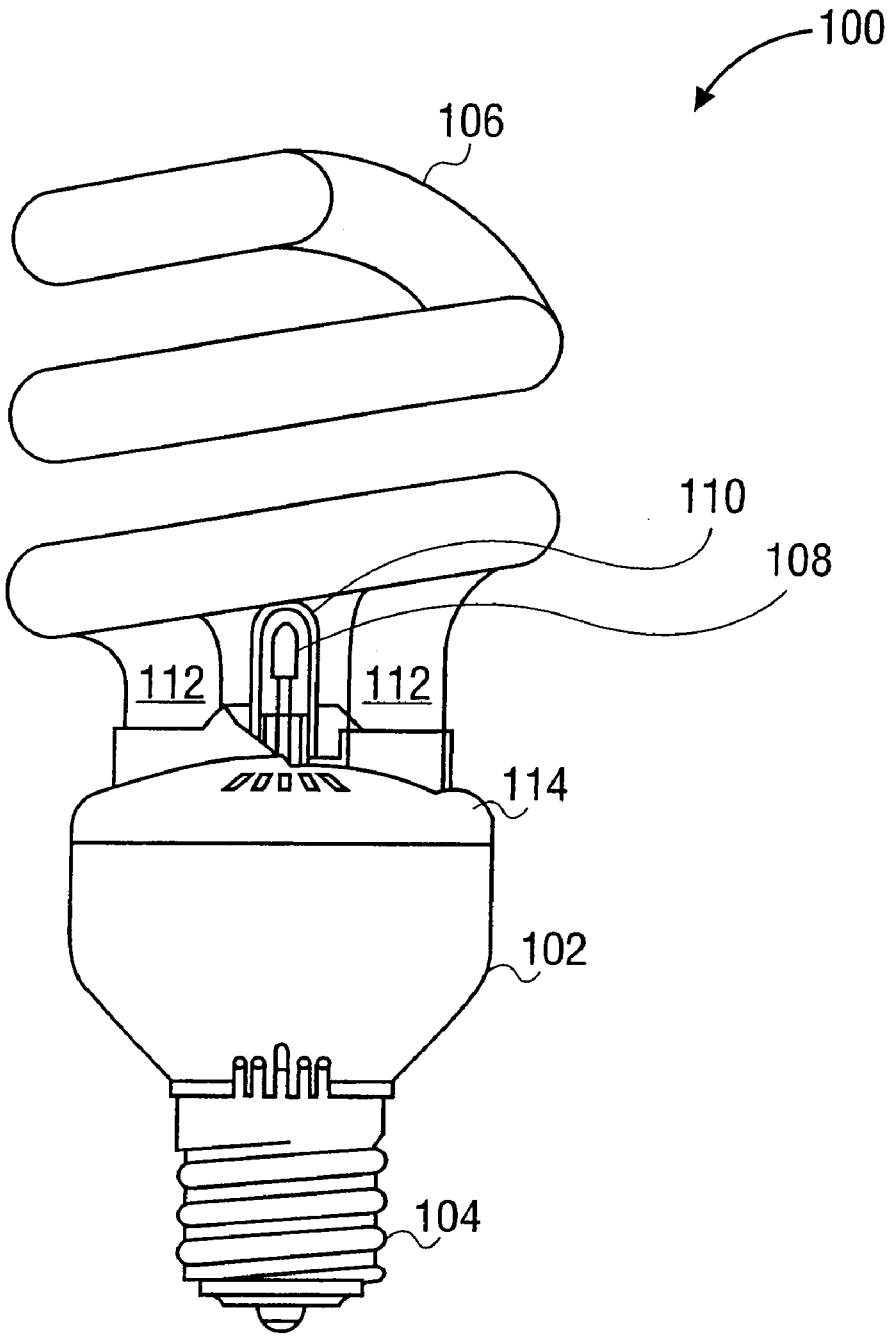
FIG. 1 is an elevational view of a lamp unit according to one embodiment of the invention.
Figure 3:
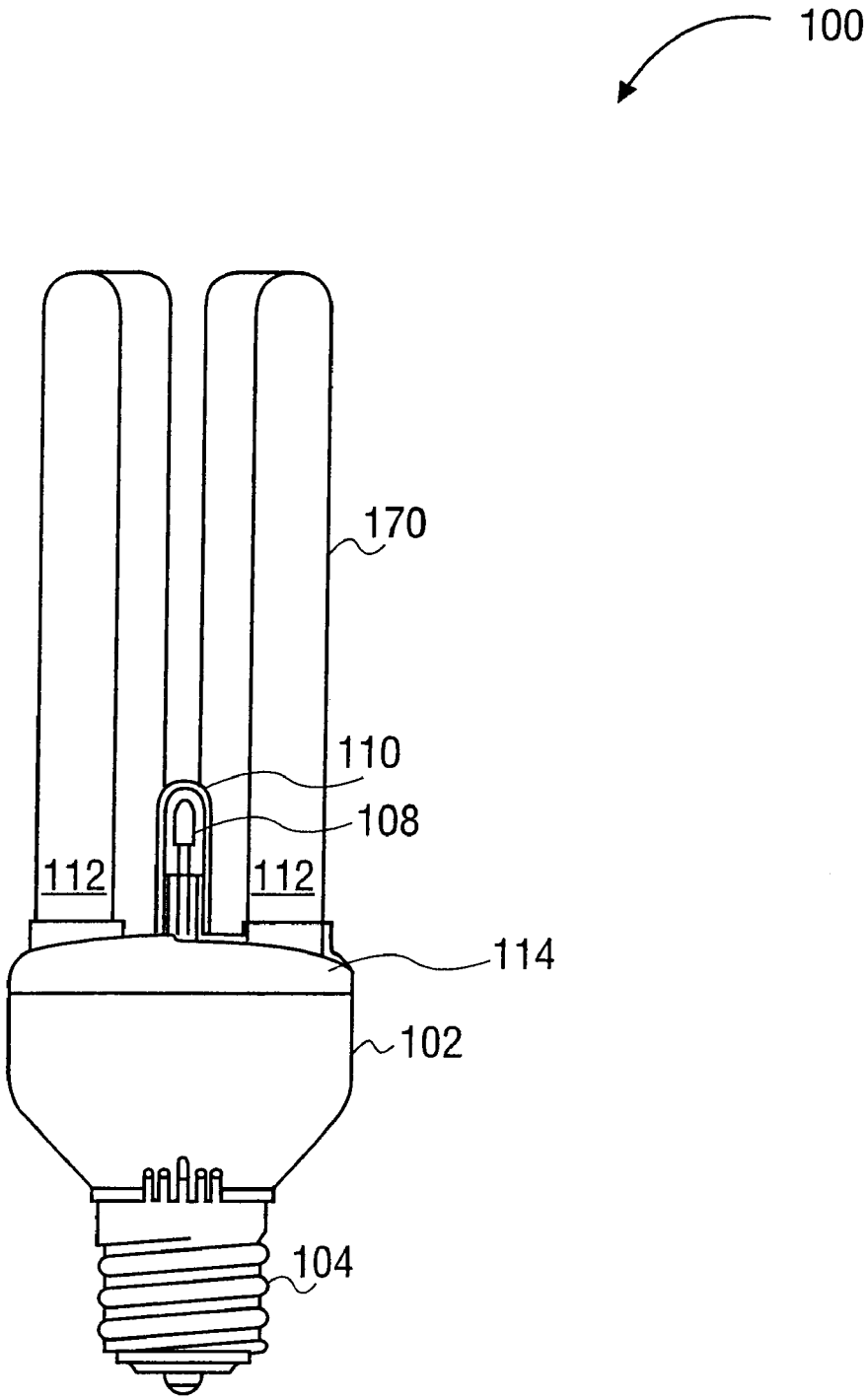
FIG. 3 is an elevational view of a lamp unit of the invention incorporating a U-shaped fluorescent lamp tube.
Figure 4:
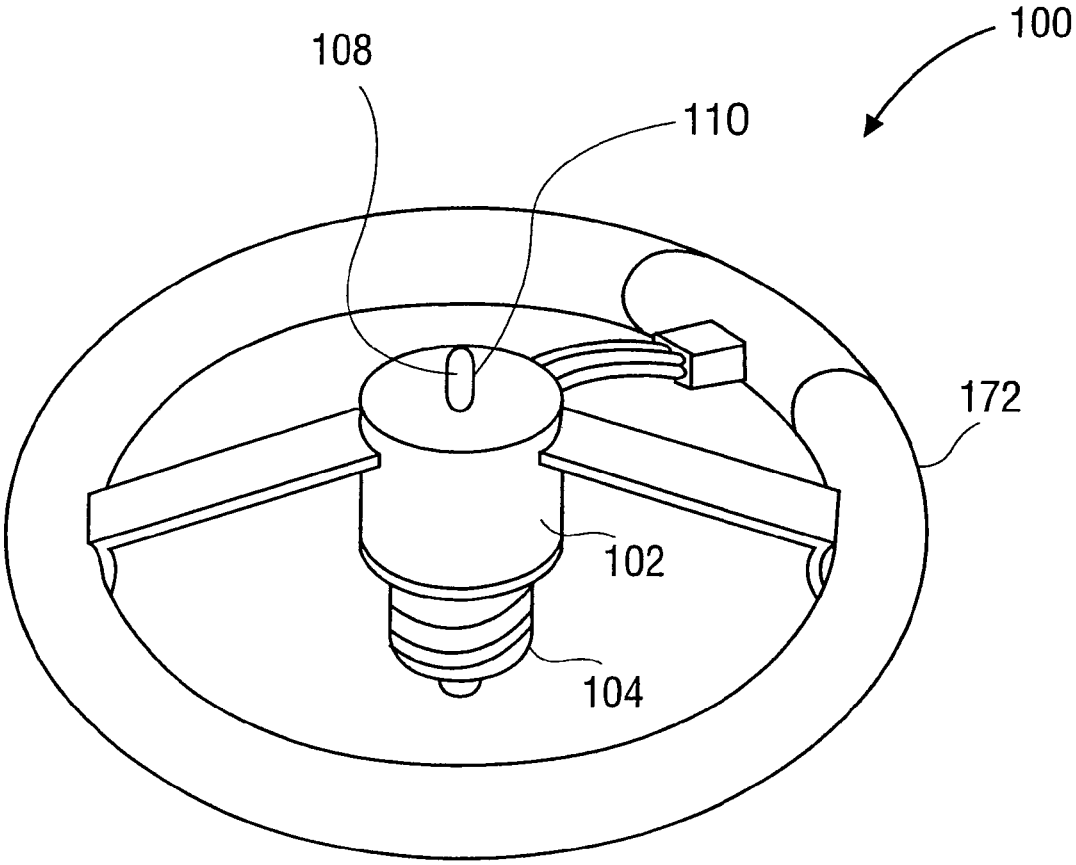
FIG. 4 is a diagrammatic perspective view of a lamp unit of the invention incorporating a circular fluorescent lamp tube.

FIG. 1 depicts a lamp unit 100 according to one embodiment of the present invention. The lamp unit 100 generally includes a housing 102, a conductive base 104, a fluorescent tube 106 and a low power light source 108 ("LPLS"). The conductive base 104 (e.g., a screw-type metal base) is attached to a neck portion of the housing 102. The fluorescent tube 106 supported by the housing generally includes an elongated glass tube having two ends and a filament provided at each of the ends. Although in the illustrated embodiment a coil type fluorescent lamp tube is shown, it should be understood that other types of fluorescent lamp tube having different shapes and sizes can also be used, including a U-shaped lamp tube 170 and a circular lamp tube 172 as shown in FIGS. 3 and 4.

The LPLS 108 is preferably of type suitable for use as a nightlight. In one embodiment, the LPLS 108 is embodied in the form of a low-wattage incandescent bulb (e.g., two watts). In this embodiment, the low-wattage bulb may be held in a socket, which is in turn electrically connected to a power source, so that the bulb is replaceable, or alternatively the low-wattage bulb can be connected to a power source by means of electrical wires welded directly onto the base of the bulb. In another embodiment, the LPLS 108 is embodied in the form of a low-wattage neon lamp (e.g., less than one watt). In yet another embodiment, the LPLS 108 is embodied in the form of a light emitting diode (LED). In the illustrated embodiment, the LPLS 108 is located on top of a housing cover 114 between two free ends 112 of the fluorescent tube 106. A transparent cover 110 is placed over the LPLS 108 to enhance the appearance of the lamp unit and to provide protection. In one implementation, the transparent cover is colored (e.g., red, green, blue) so that the color of the light emitted by the LPLS may be selected by a user (or manufacturer) by choosing a transparent cover of a corresponding color. In another implementation, the transparent cover functions to convert colored light (e.g., blue, green) emitted by a less expensive colored LED to white or colorless light.

Figure 2:
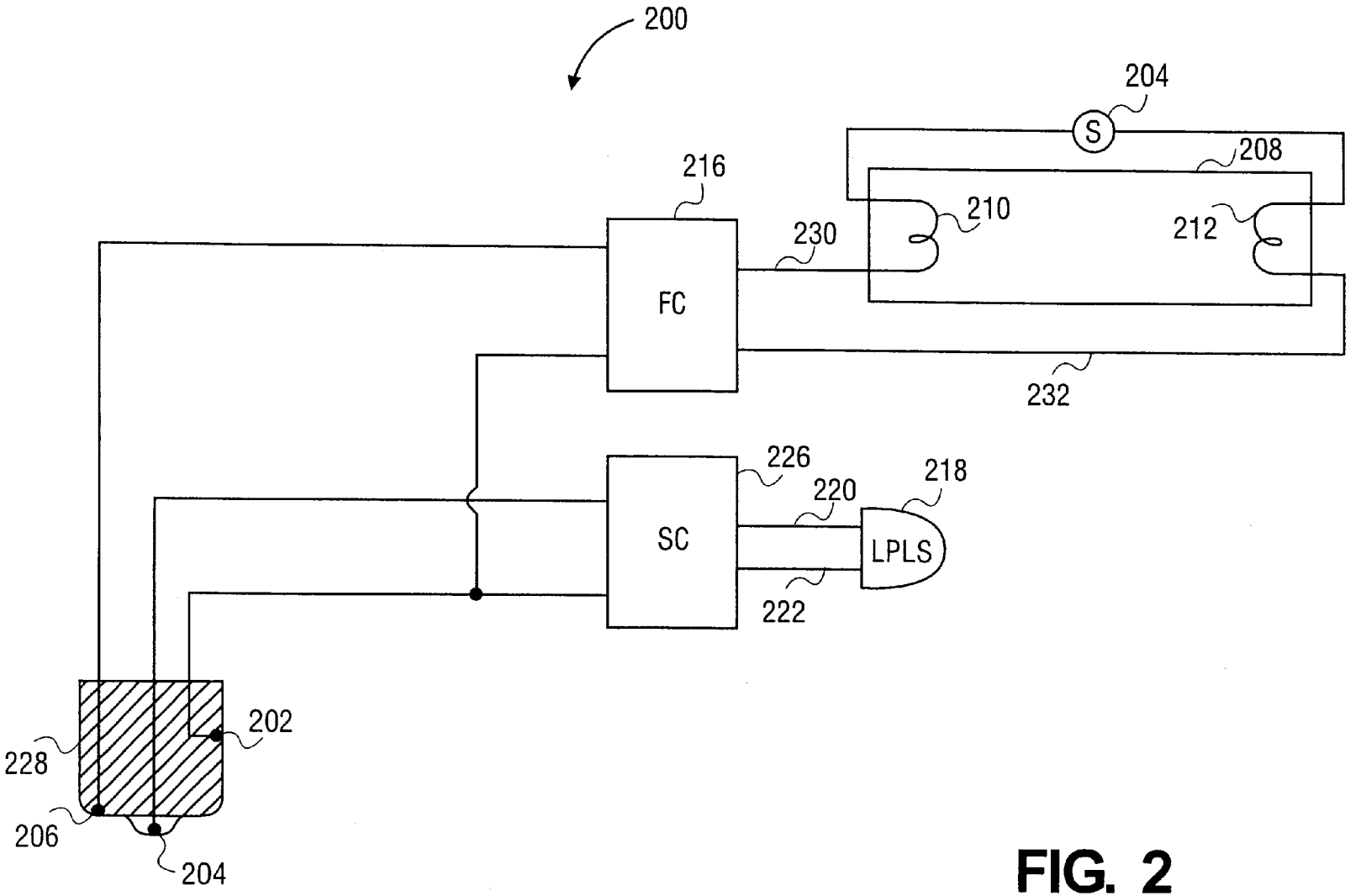
FIG. 2 is a schematic diagram of a lamp unit according to one embodiment of the invention.

FIG. 2 depicts a simplified representation of an electrical diagram of the lamp unit 200 according to one embodiment of the invention. In one embodiment, the lamp unit 200 is adapted for use with a three-way lamp socket (not shown).

In this regard, three contact terminals are provided on a conductive base 228, namely a shell 202, a central terminal 204 and a ring terminal 206. Included in the lamp unit is a fluorescent tube 208 having two ends and first 210 and second 212 filament provided at the ends thereof. A starter element 214 connects an end of each of the filaments 210, 212 in series to charge up sufficient potential so that an arc can initiate between the filaments inside the fluorescent tube. The remaining ends 230, 232 of the filaments are electrically connected to a first pair of contact terminals via a first circuit 216 ("FC"). In the illustrated embodiment, the remaining ends 230, 232 of the first and second filaments are coupled to the FC 216 which in turn is coupled to the ring terminal 206 and the shell 202.

Operatively coupled to a second pair of contact terminals is an LPLS 218 having two conductive wires 220, 222 extending therefrom. In the illustrated embodiment, one wire 220 of the LPLS 218 is electrically connected to the center terminal 204 and the other wire 222 is electrically connected to the shell 202 via a second circuit 226 ("SC"). The FC 216 and SC 226 to drive the fluorescent lamp 208 and the LPLS 218 are well known to persons of ordinary skill in the art and will not be discussed herein.

In use, the lamp unit 200 may be received in a three-way lamp socket having a three-way switch for operating the lamp unit. The lamp socket is connected to a power source to supply the lamp unit with electrical power. Typically, a three-way switch is adjustable between an off position ("OFF"), a first position ("P1"), a second position ("P2") and a third position ("P3"). The standard mode of three-way switch sequence is OFF-P1-P2-P3-OFF. In P1, the power source is connected across the shell 202 and center terminal 204 of the lamp unit base 228 to supply power to the LPLS 218 so that it can function as a nightlight. In P2, the electrical source is connected across the shell 202 and ring terminal 206 to supply power to the fluorescent lamp filaments 210, 212 so that it can function as a fluorescent lamp. In P3, the electrical source is connected across the shell 202 and the combination of the center terminal 204 and ring terminal 206 to supply power to both the fluorescent tube 208 and the LPLS 218. No electrical power is applied to the lamp unit 200 in the off position.

The lamp unit may be used in any place that nightlight and fluorescent lamp illumination is desired. Normally, the lamp unit can function as any ordinary fluorescent lamp to illuminate a selected area. During sleep period, a three-way switch may be adjusted to enable the lamp unit to function as a nightlight to illuminate the selected area with a low level of illumination to assist family members and guests navigate their way through corridors and rooms without blinding them whose eyes that have been adjusted to the darkness.

Although the illustrated lamp unit is adapted for use with a three-way lamp socket, it should be understood by those skilled in the art that the lamp unit of the present invention can be easily modified so that it can be used with other types of lamp sockets and adapters. Such is within the scope and contemplation of the invention.

Figure 5:
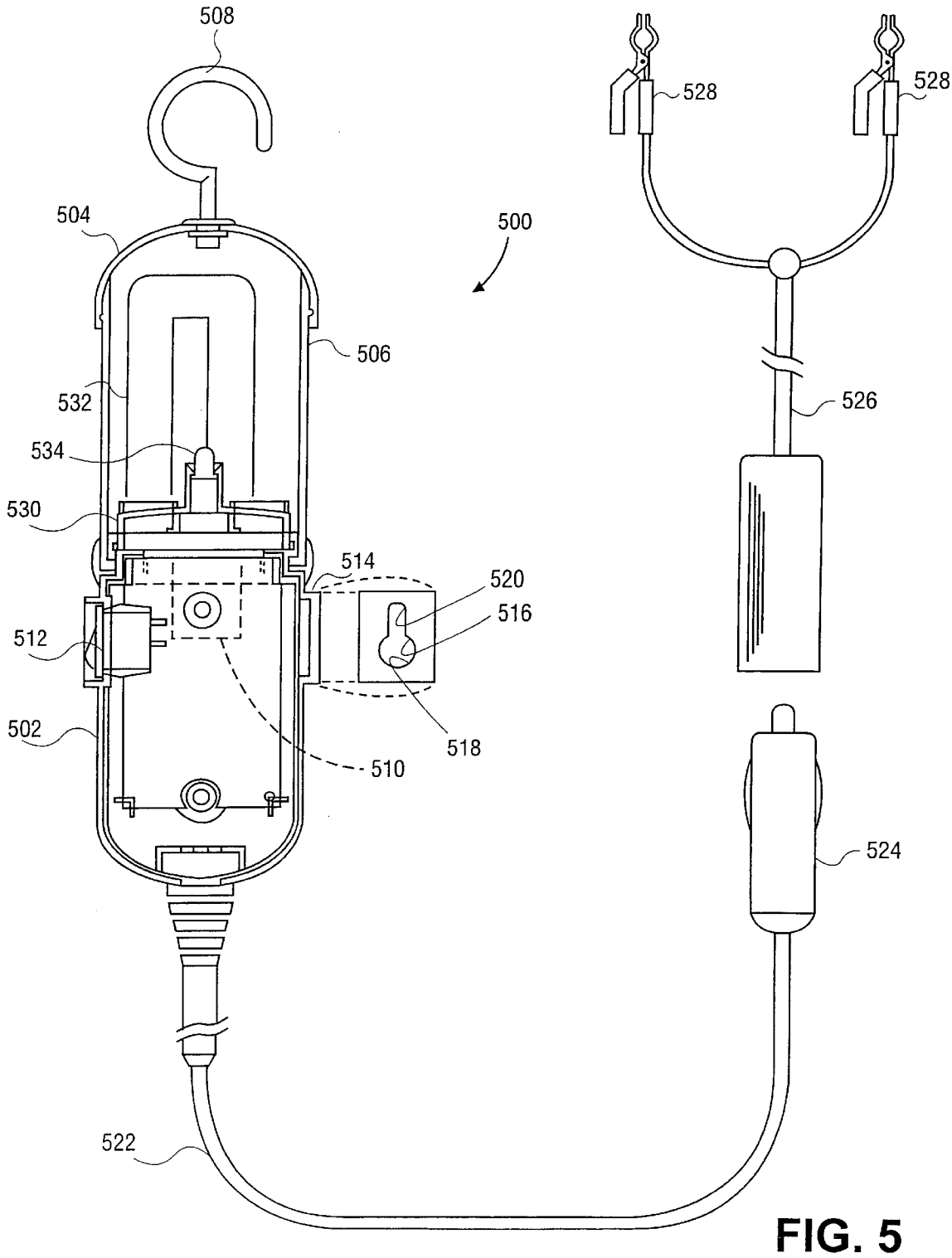
FIG. 5 is an elevational view of a hangable portable lamp assembly according to one embodiment of the invention, with parts broken away.
Figure 6:
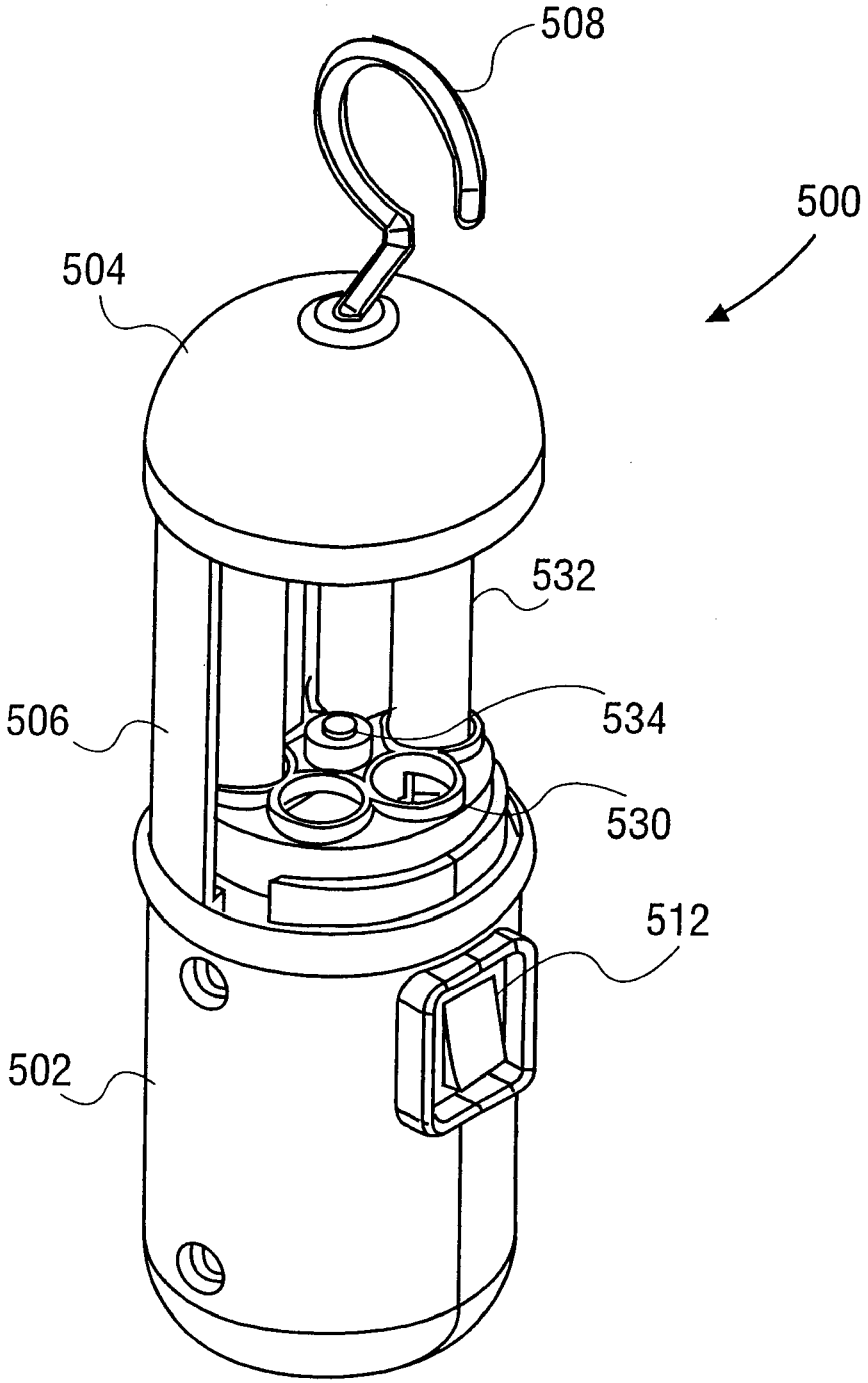
FIG. 6 is a diagrammatic perspective view of the hangable portable lamp assembly according to one embodiment of the invention.

FIGS. 5 and 6 depict a hangable portable lamp assembly 500 (HPLA) according to one embodiment of the invention. The HFLA 500 generally includes a housing 502, a cap 504 and a protective cover 506 positioned between the housing and the cap. A hook 508 is provided on the top of the cap 504 to enable the HPLA 500 to be suspended from a support structure. In accordance with one aspect of the invention, the HPLA 500 is adapted for use with a lamp unit 530 having a fluorescent tube 532 and a LPLS 534. For this purpose, a three-way lamp socket 510 is incorporated into the HPLA 500. The socket 510 is supported by the housing 502 and has a threaded receptacle sized and shaped to receive the conductive base of the lamp unit. The three-way lamp socket has electrical contacts in the receptacle which are positioned to establish electrical contact with contact terminals of the lamp unit when the conductive base is received in the receptacle.

In connection with the lamp socket 510 is a switch 512 (e.g., a two-way or three-way switch) for selectively turning the fluorescent tube 532 and LPLS 534 of the lamp unit 530 on and off. According to one aspect of the HPLA 500, an elevated portion 514 with a keyhole 516 is provided on the outer surface of the housing. The elevated portion 514 with the keyhole 516 allows the HPLA to be supported by a vertical support structure or alternatively by an overhead structure either in a normal vertical orientation or in a horizontal orientation. The keyhole 516 comprises at least two keyhole edges. One edge is formed by a substantially circular cutout 518 and another edge is formed by a substantially oval cutout 520.

In one embodiment, the HPLA 500 is adapted for use in or near a vehicle. In this regard, a flexible power cord 522 extending from the HPLA is provided with a cigarette lighter adapter 524 for plugging into a cigarette lighter socket of a vehicle. The cigarette lighter adapter 524 is attachable with a battery connection adapter 526 having a pair of connecting clips 528 for direct connection with a battery (e.g., of a vehicle) or other power supply. This enables the HPLA 500 to be used outdoors (e.g., at campsite) to provide fluorescent illumination during the evening and nightlight illumination during sleep period to illuminate a selected outdoor area with a dim illumination.

Figure 7:
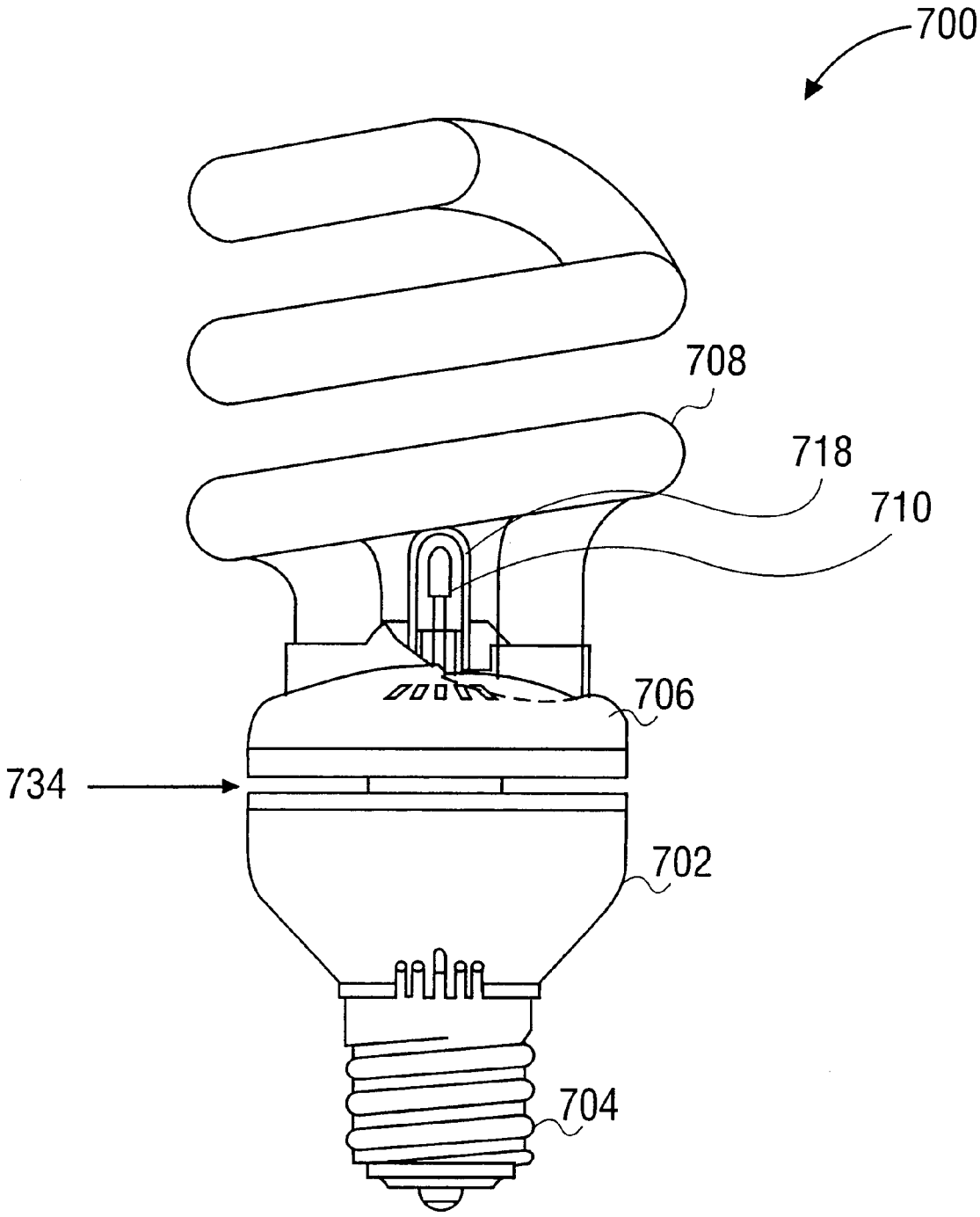
FIG. 7 is an elevational view of a lamp unit according to another embodiment of the invention.
Figure 8:
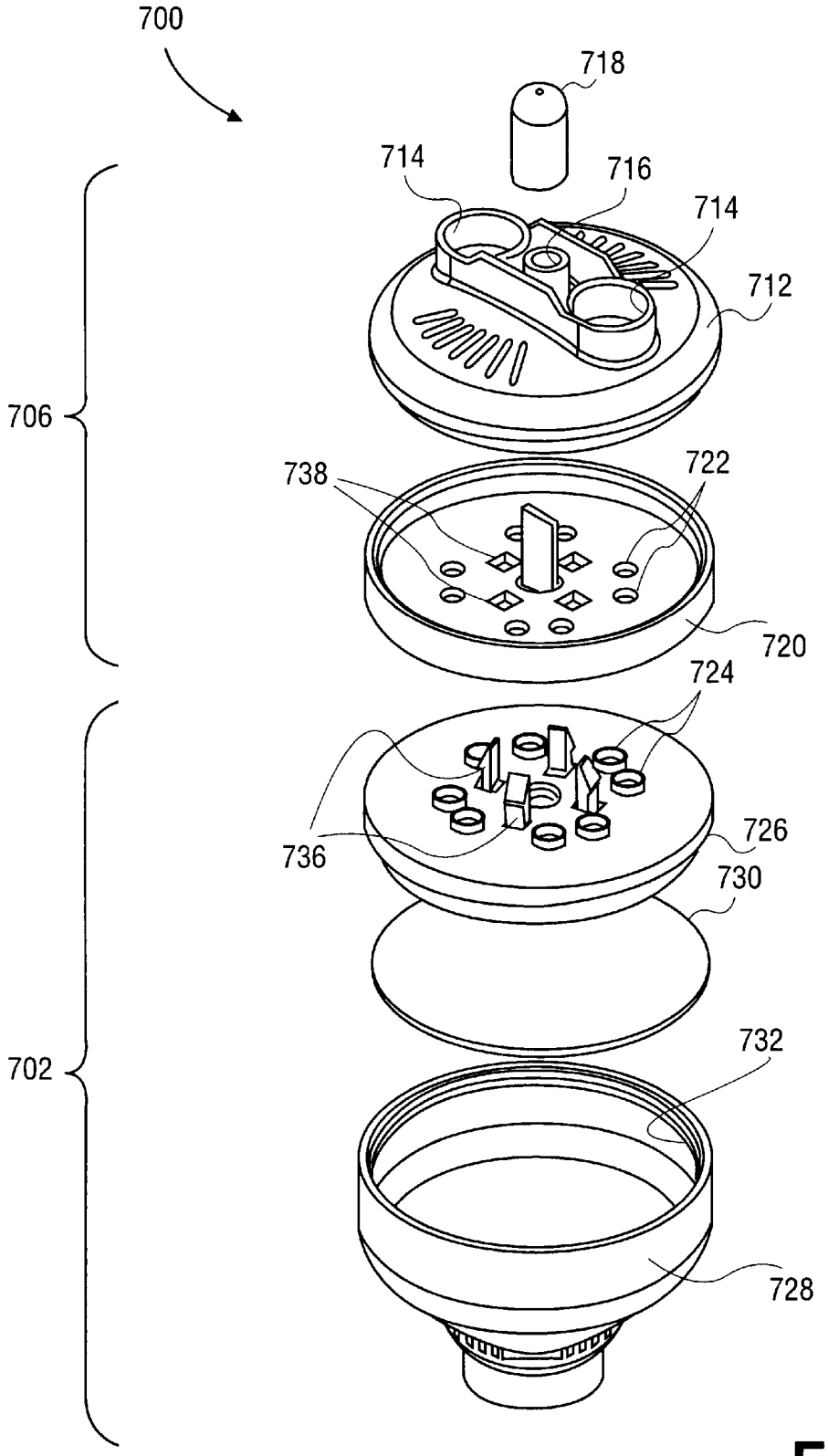
FIG. 8 is an exploded view of the lamp unit according to another embodiment of the invention.

FIGS. 7 and 8 depict a compact lamp unit with a heat sink 700 ("CLHS") according to another embodiment of the invention. In accordance with one aspect of the invention, the CLHS 700 functions both as a fluorescent lamp and as a nightlight. In this regard, the CLHS 700 includes a housing 702, a conductive base 704, a support member 706, a fluorescent tube 708 and a LPLS 710. In accordance with one aspect of this embodiment, the housing 702 and the support member 706 is configured to protect temperature-sensitive components residing within the housing 702 from the heat generated by the fluorescent tube 708. In one implementation, the support member 706 includes a support-member cap 712 having lamp-tube-receiving portions 714 to receive the free ends of the lamp tubes and a LPLS receiving portion 716 to receive the LPLS. A transparent cover 718 is placed over the LPLS to enhance the appearance of the lamp unit and to provide protection from external environment. Attached to the support-member cap 712 is a support-member base 720, which is configured to close the lower open portion thereof. A number of spaced apart holes 722 are provided on the support-member base 720 positioned to receive one of electrical wiring guides 724 extending from the top surface of a housing cap 726.

The housing 702 of the CLHS 700 includes a housing base 728 for containing, among other thing, circuitry 730 necessary for driving the fluorescent tube 708 and the LPLS 710. The housing cap 726 attached to the housing base 728 to close the upper end portion 732 of the housing 728 and to further shield components residing within the housing from heat generated by the lamp tube. A number of electrical wiring guides 724 extend from the top surface of the housing cap 726 to accommodate passage of electrical wiring from the lamp tubes 708 and LPLS 710 to the circuitry in the housing. The support member 706 is connected to the housing 702 such that an air gap 734 is provided between the support member 706 and the housing 702 to reduce the transfer of heat from the lamp tubes to the interior of the housing. In the illustrated embodiment, the housing cap 724 is provided with locking pins 736 to allow the support member to be secured to the housing by passing the lock pins through holes 738 provided in the support-member base 720. Other fastening methods may be employed to securely attach the support member to the housing. One exemplary lamp unit with an integrated heat sink is described in a co-pending U.S. application Ser. No. 09/632,291 to Byung II Ham, entitled "Compact fluorescent lamp with an integrated heat sink," which is incorporated herein by reference.

While the foregoing embodiments of the invention have been described and shown, it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. A compact fluorescent lamp unit comprising:

a housing having a lower end and an upper end;

a housing cover to cover said upper end of said housing;

a fluorescent tube supported by said housing cover and located on top of said housing cover;

a low power light source supported by said housing cover;

an electrically conductive base attached to said lower end of said housing to mate with a lamp socket and includes a first contact terminals, a second contact terminal and a third contact terminal positioned on said base so as to establish electrical contact with socket contacts when said base is received in the lamp socket;

a first circuit coupled between said fluorescent tube and a first pair of said contact terminals of said base to drive said fluorescent tube; and a second circuit coupled between said low power light source and a second pair of said contact terminals of said base to drive said low power light source.

2. The lamp unit of claim 1, wherein said conductive base is configured for use with a three-way lamp socket.

3. The lamp unit of claim 1, wherein said low power light source is a low-wattage incandescent bulb.

4. The lamp unit of claim 1, wherein said low power light source is a light emitting diode.

5. The lamp unit of claim 1, wherein said low power light source is a low-wattage neon lamp.

6. The lamp unit of claim 1, wherein said fluorescent tube is selected from one of the following; a coil type fluorescent lamp tube, a U-shaped lamp tube and a circular lamp tube.

7. The lamp unit of claim 1, wherein said electrically conductive base is adapted for use with a two-way lamp socket.

8. The lamp unit of claim 1, further comprising a transparent cover placed over said low power light source.

9. The lamp unit of claim 8,herein said transparent cover is colored so that the color of light emitted by the LPLS may be selected by choosing a transparent cover of a corresponding color.

10. The lamp unit of claim 8, wherein said transparent cover is configured such that the light emitted by a colored LPLS appears colorless.

11. A compact lamp unit with a heat sink, comprising:

a fluorescent tube having free ends;

a low power light source;

a support member to support said fluorescent tube and said low power light source, said support member including a support-member cap having lamp-tub-receiving portions to receive said free ends of said lamp tubes and a light source receiving portion to receive said low power light source, said support member further including a support-member base to close a lower open portion of said support-member cap;

a housing having a neck portion;

an electrically conductive base attached said neck portion of said housing, said conductive base having contact terminals;

a first circuit coupled between said fluorescent tube and two of said contact terminals of said base to drive said fluorescent tube;

a second circuit coupled between said low power light source and two of said contact terminals of said base to drive said low power light source.

12. The compact lamp unit of claim 11, wherein said low power light source is a low-wattage incandescent bulb.

13. The compact lamp unit of claim 11, wherein said low power light source is a light emitting diode.

14. The compact lamp unit of claim 11, wherein said low power light source is a low-wattage neon lamp.

15. The compact lamp unit of claim 11, further comprising a transparent cover placed over said low power light source.

16. The compact lamp unit of claim 11, wherein said housing further comprises a housing cap to close an upper open portion of said housing to shield components residing within the housing from heat generated by said fluorescent tube.

17. The compact lamp unit of claim 16, wherein said support member is connected to said housing such that an air gap is formed between the support-member base and the housing cap.

18. A portable lamp assembly comprising:

a compact fluorescent lamp unit having a screw-type conductive base, a first light source and a second light source, a housing, a lamp socket supported by said housing for receiving said screw-type conductive base of said compact fluorescent lamp unit, said lamp socket having electrical contacts positioned in said socket to be in electrical contact with contact terminals of the lamp unit when the conductive base is received in said socket;

a cap;

a protective cover positioned between the housing and the cap; and a switch coupled to said electrical contacts of said lamp socket for selective turning the first light source and the second light source of said compact fluorescent lamp unit on and off.

19. The portable lamp assembly of claim 18, wherein said lamp socket is a three-way lamp socket having three electrical contacts.

20. The portable lamp assembly of claim 18, wherein said lamp unit comprises a fluorescent tube, a low power light source, a base having contact terminals, a first circuit coupled between said fluorescent tube and a first pair of said contact terminals of said base to drive said fluorescent tube, and a second circuit coupled between said low power light source and a second pair of said contact terminals of said base to drive said low power light source.

21. The portable lamp assembly of claim 18, wherein said switch is a two-way switch.

22. The portable lamp assembly of claim 18, wherein said switch is a three-way switch.

23. The portable lamp assembly of claim 18, further comprising an elevated portion with a keyhole integrally molded on the housing.

24. The portable lamp assembly of claim 18, wherein said low power light source is a low-wattage incandescent bulb.

25. The portable lamp assembly of claim 18, wherein said low power light source is a light emitting diode.

26. The portable lamp assembly of claim 18, wherein said low power light source is a low-wattage neon lamp.

* * * * *